United States Patent [19]

Johns

[11] 4,129,871

[45] Dec. 12, 1978

[54] CIRCULARLY POLARIZED ANTENNA USING SLOTTED CYLINDER AND CONDUCTIVE RODS

[75] Inventor: McKinley R. Johns, Cherry Hill, N.J.

[73] Assignee: RCA Corporation, New York, N.Y.

[21] Appl. No.: 832,460

[22] Filed: Sep. 12, 1977

[51] Int. Cl.[2] ..... H01O 13/12

[52] U.S. Cl. ..... 343/727; 343/771

[58] Field of Search ..... 343/725, 727, 728, 729, 343/730, 770, 771, 756

[56] References Cited

U.S. PATENT DOCUMENTS 3,340,534 9/1967 Fee ..... 343/728

*Primary Examiner*—Eli Lieberman

*Attorney, Agent, or Firm*—Eugene M. Whitacre; Paul J. Rasmussen; Robert L. Troike

[57] ABSTRACT

A circularly polarized antenna is provided using a slotted conductive mast. The slots extend about one-half wavelength long along the lengthwise axis of the mast for exciting horizontal components of the wave. Conductive rods extend from a point near each elongated side of the slot with each rod being about one full wavelength long and having a free end portion extending in the vertical plane approximately one-half wavelength to radiate the vertical component of the wave.

8 Claims, 3 Drawing Figures

CIRCULARLY POLARIZED ANTENNA USING SLOTTED CYLINDER AND CONDUCTIVE RODS

BACKGROUND OF THE INVENTION

This invention relates to circularly polarized antennas and, more particularly, to such antennas using slotted conductive cylinders.

Although television has been broadcast in horizontal polarization in the U.S.A., it appears from recent test results that circularly polarized broadcasting might well greatly improve television reception in large metropolitan areas. Further, broadcast antennas must often broadcast an omnidirection pattern about the tower such that when this tower is erected in the center of a city, for example, substantially equal coverage is provided about the city.

Slot antennas like that described by Bazan in U.S. Pat. No. 2,981,947 are presently being used for providing horizontally polarized television broadcasting. This type of antenna provides a good omnidirectional pattern. Since broadcasters have expended considerable cost for this slot type antenna, it would be desirable to provide some means of converting this type of antenna to provide a circularly polarized broadcasting antenna. This is especially true for UHF stations where the operating budgets are smaller and there is a wide use of the slot antenna.

SUMMARY OF THE INVENTION

Briefly, a circularly polarized antenna system is provided by longitudinally extending slots in a conductive cylindrical mast and a pair of conductive elements associated with each of said slots. Each of said slots are at least one-half wavelength long at the operating frequency of the antenna. Each of the slots are fed to excite horizontally polarized waves. Each of the pair of conductive elements excite vertically polarized waves. The conductive elements are each approximately one wavelength long with one conductive element fixed near the mid point of one elongated side of the slot and having a free end portion extending in one longitudinal direction and the other conductive element being fixed at one end to a feed point near the mid point of the opposite side of the slot and having a free end portion extending in an opposite longitudinal direction.

DESCRIPTION OF THE INVENTION

Figure 1:
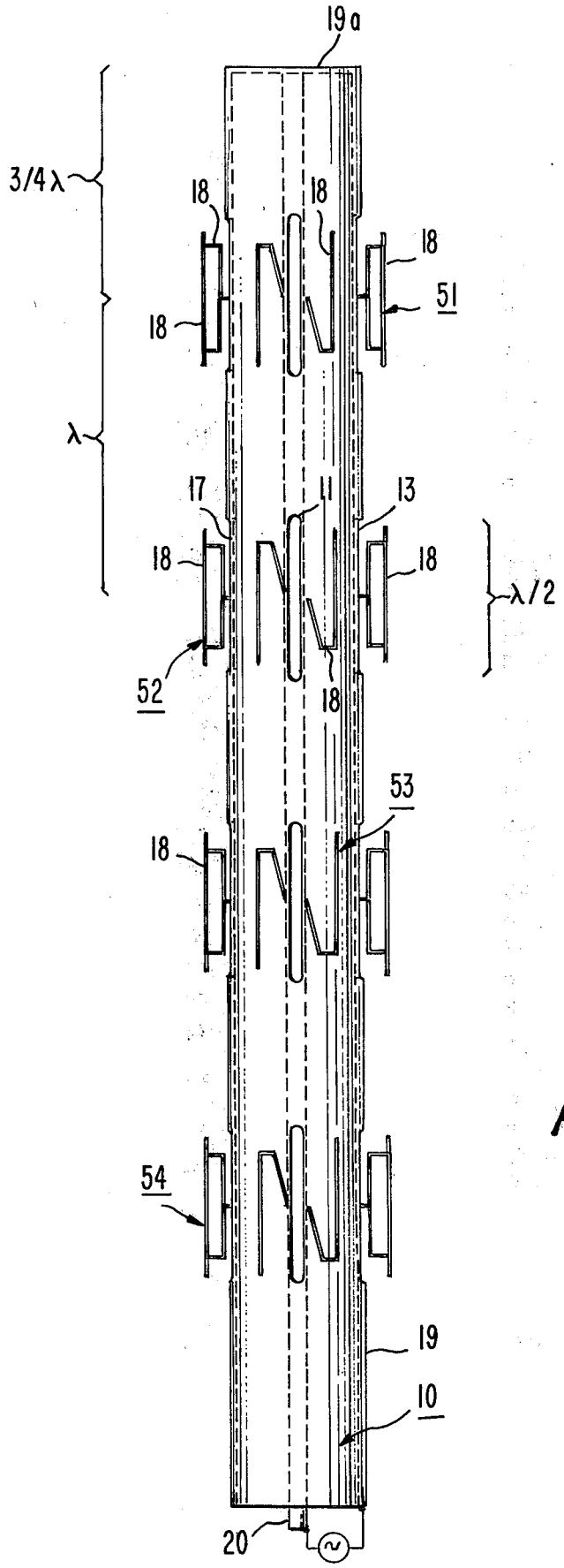
FIG. 1 is an elevation view of an antenna system according to the present invention.

Referring to FIG. 1, an omnidirectional antenna system 10 is shown comprising four identical stacked subsystems 51, 52, 53 and 54. Each subsystem comprises four longitudinal slots and linear conductors. The omnidirectional antenna system includes a coaxial transmission line having an inner conductor 20 and an outer conductive mast 19. Signals at the operating frequency of the antenna are coupled at the bottom end of the mast 19 between the center conductor and the outer conductor or mast 19. The mast 19 has a terminating short at the remote end 19*a* to excite a standing wave. The longitudinal center of the first plurality of slots of subsystem 51 is located, for example, three-quarters of a wavelength at an operating frequency of the antenna from the terminated end 19*a*. The term "wavelength" when used herein refers to a wavelength at an operating frequency of the antenna system. The center of the second plurality of slots of subsystem 52 is spaced a full wavelength from the longitudinal mid point of the slots of subsystem 51. Similarly, the center of the third plurality of slots of subsystem 53 are spaced a full wavelength from the mid point of the slots of subsystem 52. Similarly, the center of the slots of subsystem 54 are spaced a full wavelength from the mid point of the slots of subsystem 53. These slots are thereby centered at the high impedance points of the standing wave. Associated with each slot of the plurality of slots is a pair of approximately one wavelength long linear conductors 18.

Figure 2:
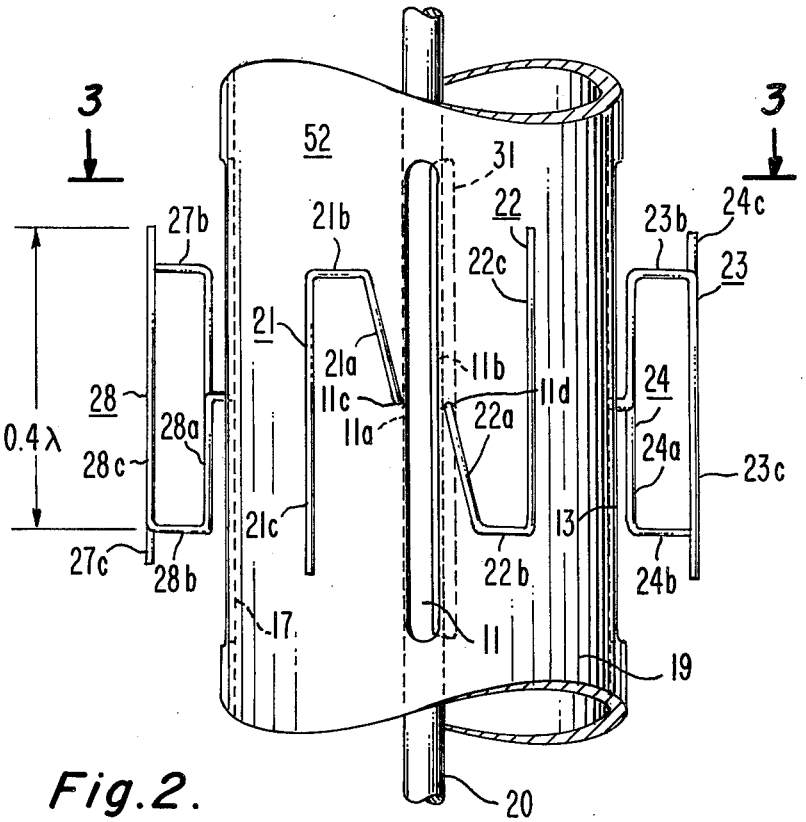
FIG. 2 is an elevation view of a subsystem of FIG. 1 according to one embodiment of the present invention.
Figure 3:
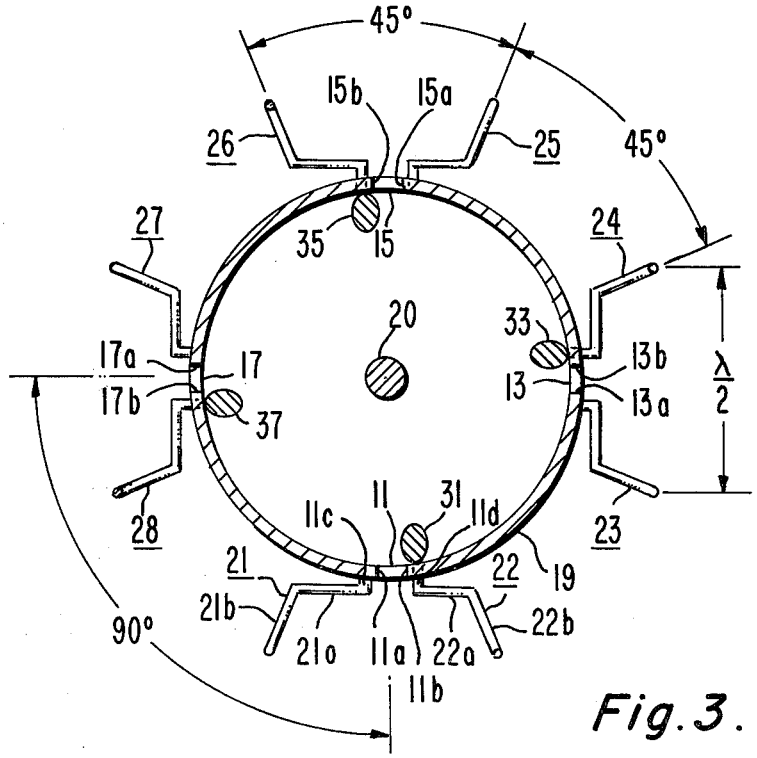
FIG. 3 is a cross-sectional view of the antenna subsystem taken along line 3 - 3 in FIG. 2.

Referring to FIGS. 2 and 3, the subsystem 52 including the slots is illustrated in more detail. The four slots 11, 13, 15 and 17 of subsystem 52 extend along the longitudinal axis of the mast a length of about one-half wavelength ($\lambda/2$) at an operating frequency of the antenna. The slots 11, 13, 15 and 17 were made 0.05 wavelengths or slightly greater than one-half wavelength at the operating frequency. The width of each of the slots is on the order of 0.08 wavelength ($\frac{5}{8}$ inch — for an operating frequency of 1500 MHz for example). The slots 11, 13, 15 and 17 are located 90° of arc and about one-half wavelength from each other about the mast. The slots 11, 13, 15 and 17 are excited for example by elongated coupling probes 31, 33, 35 and 37. The probe 31 extends about one-half wavelength long along the inside longitudinal edge 11*b* of slot 11. Similarly, probes 33, 35 and 37 are about one-half wavelength long and extend along the inside longitudinal edges 13*b*, 15*b* and 17*b* of the respective slots 13, 15 and 17. The probes 31, 33, 35 and 37 are similar to the probes in Bazan, U.S. Pat. No. 2,981,947. Similarly, the slots of subsystem 51, 53 and 54 are excited. In the arrangement shown in FIGS. 1 thru 3 with only the slots horizontally polarized waves in an omnidirectional pattern is excited. This antenna with the slots alone would function in a manner similar to that described in the above cited patent.

Circular polarization is achieved herein using the above described well known type of antenna by exciting vertically polarized waves in phase quadrature to the horizontally polarized waves radiated from the slots using the conductive rods 18 fed on each side of the slots. These conductive rods 18 in FIG. 1 are each approximately one wavelength long elements with one end fixed near the mid point of an elongated side of a slot with a one-half wavelength portion at the free end of the rods extending in a vertical direction. Referring for example to FIG. 2 and 3, vertically polarized waves are excited in phase quadrature using the rods 21, 22, 23, 24, 25, 26, 27 and 28 spaced about slots 11, 13, 15 and 17. The rods 21 and 22 extend from points 11*c* and 11*d* respectively located near opposite longitudinal sides 11*a* and 11*b* of slot 11. The points 11*c* and 11*d* are midway between the longitudinal ends of slot 11. Similarly, rods 23 and 24 extend from points respectively on the opposite longitudinal sides 13*a* and 13*b* of slot 13. Similarly, rods 25 and 26 extend from feed points on the opposite longitudinal sides 15*a* and 15*b* of slot 15 and rods 27 and 28 extend from points on opposite elongated sides 17*a* and 17*b* of slot 17. The rod 21 extends generally vertically, and away from the slot over a first portion 21*a*. The rod 21 extends horizontally away from the mast and away from the slot over the second portion 21*b*. The length of the rod 21 over the first and second portions is about one-half wavelength at the operating frequency of the antenna. The rod 21 extends vertically downward over a third free end portion 21*c*. The third portion 21*c* is slightly less than one-half wavelength long at the operating frequency of the antenna. The third portion 21*c* is about one tenth of a wavelength less than one-half wavelength or about 0.4 wavelength long. The total length of rod 21 is approximately a full wavelength at the operating frequency. The rod 21 may therefore be considered an end fed full wave radiator. The rod 22 extending from the opposite side of the aperture 11 extends generally downward and away from the slot 11 in an opposite direction over the first portion 22*a*. The rod 22 over the second portion 22*b* extends horizontally away from the slot and the mast 19. The length of the rod 22 over the first and second portions is one-half wavelength at the operating frequency of the antenna. The rod 22 extends vertically upward over a third free end portion 22*c*. The length of the rod 22 over the third portion 22*c* is slightly less than ($\lambda/10$ less) one-half wavelength long at the operating frequency of the antenna (about 0.4 wavelength long). The total length of rod 22 is approximately a full wavelength. The rod 22 may therefore be considered an end fed full wave radiator. The rods 21 and 22 are oriented such that the third portions 21*c* and 22*c* are centered with respect to the slot 11 as shown in FIG. 2. The rods 23, 25 and 27 are identical to rod 21 and the rods 24, 26 and 28 are identical to rod 22. The third or free end portion of the rods 23, 24, 25, 26, 27 and 28 are slightly less than (one tenth of a wavelength less than) one-half wavelength long and are centered with respect to their respective slots. The first and second portions of rods 21, 22, 23, 24, 25, 26, 27 and 28 extend from the mast 19 such that the third portions are spaced every 45° of arc around the mast 19 as shown in FIG. 2. Since length of the combined portions 21*a* and 21*b* of rod 21 is about one-half wavelength from the feed point 11*c* at the dipole slots to vertical portion 21*c* and the combined length of the first two portions of the rod 22 to the vertical portion 22*c* are each about one-half wavelength at an operating frequency of the antenna, quadrature phasing is provided between the horizontally polarized waves radiated from the slot 11 and the vertically polarized waves radiated from the third portion of rods 21 and 22. Similarly, there is quadrature phasing between signals radiated from the slot 13 and the rods 23 and 24, from the slot 15 and the rods 25 and 26 from the slot 17 and the rods 27 and 28. The rod 22 is fed 180° out of phase with respect to rod 21 by the coupling probe 31 on the inside of mast 19. Similarly, the pair of rods 23 and 24, 25 and 26 and 27 and 28 associated with each slot are fed 180° out of phase with each other. The portion 21*c* of rod 21 is spaced approximately one-half wavelength at an operating frequency of the antenna from portion 22*c* of rod 22. Since these end radiating portions are one-half wavelength apart, the radiation in the common plane of these end radiating portions cancel. Similarly, the end radiating portions of the two rods 23 and 24, 25 and 26 and 27 and 28 associated with each slot are spaced about a half-wavelength apart to achieve this cancellation. This cancellation of radiation prevents signals radiated in the directions in the plane of the two rods from interfering with the radiation from the other radiators to form nulls or cancellation in these directions and reinforcement in other directions and thereby not achieve the desired omnidirectional circularly polarized pattern.

What is claimed is:

1. A circularly polarized antenna system comprising:

a conductive cylindrical mast having longitudinally extending slots, each of said slots being about one-half wavelength long at an operating frequency of the antenna, means for feeding each of said slots for exciting horizontally polarized waves, and a pair of conductive elements associated with each of said slots for exciting vertically polarized waves, each of said conductive elements being approximately one wavelength resonant elements at said operating frequency, one of the conductive elements of each pair being fixed at one end to a feed point near the midpoint of one elongated side of said slot and having a free end portion extending parallel to the slots and in one longitudinal direction and the other of said conductive elements of each pair being fixed at one end to a feed point near the midpoint of the opposite elongated side of said slot and having a corresponding free end portion extending parallel to the slots and in longitudinal direction opposite said first direction.

2. The combination claimed in claim 1 wherein, said means for feeding each of said slots includes a center conductor coaxial with and extending inside said conductive cylindrical mast and a conductive member extending toward said center conductor from one of said elongated sides of said slot.

3. The combination claimed in claim 2 wherein, said conductive member is an elongated conductive member which extends approximately one-half wavelength long at said operating frequency of said antenna along an elongated side of said slot.

4. The combination claimed in claim 1 wherein, said slots are spaced one-half wavelength apart about the periphery of the mast, said wavelength being at an operating frequency of the antenna.

5. The combination claimed in claim 1, wherein said free end portion of said one conductive element is spaced one-half wavelength at an operating frequency of the antenna from said opposite extending free end portion of said other conductive element.

6. The combination claimed in claim 5, wherein said free end portions are approximately one-half wavelength long, said free end portions are centered with respect to said slots along the lengthwise axis of the mast.

7. The combination claimed in claim 6, wherein free end portions of said conductive elements are spaced every 45° around the mast.

8. A circularly polarized antenna system comprising:

a coaxial transmission line having an inner conductor and an outer conductor, said outer conductor having a circumference approximately equal to two wavelengths at an operating frequency of said antenna system, four longitudinally extending slots with each of said slots being spaced approximately one-half wavelength at an operating frequency of the antenna from each other, each of said slots being at least one-half wavelength long at an operating frequency of the antenna, an elongated conductive member fixed along an elongated side of each of said slots of said outer conductor and extending toward said center conductor, and a pair of conductive elements associated with each of said slots, each of said conductive elements being approximately one wavelength long with one end of a first of said pair of conductive elements fixed to a feed point near the mid point of one elongated side of said slot and the other of said pair of conductive elements being fixed at one end to a feed point near the mid point of the opposite elongated side of said slot, each of said pair of conductive elements having a free end portion which is approximately one-half wavelength long extending parallel to said slots with the end portion of one of said conductive elements extending in a first direction and the end portion of the other of said conductive elements of each pair extending in an opposite longitudinal direction.

* * * * *

UNITED STATES PATENT AND TRADEMARK OFFICE
CERTIFICATE OF CORRECTION

PATENT NO. : 4,129,871

DATED : December 12, 1978

INVENTOR(S) : McKinley Robert Johns

It is certified that error appears in the above-identified patent and that said Letters Patent is hereby corrected as shown below:

Column 4, line 67, that portion reading "slots of said outer conductor" should read -- slots to said outer conductor --.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*